US011507022B2

(12) United States Patent
Stranczl

(10) Patent No.: US 11,507,022 B2
(45) Date of Patent: Nov. 22, 2022

(54) TIMEPIECE MOVEMENT COMPRISING A TOURBILLON WITH A FIXED MAGNETIC WHEEL

(71) Applicant: Montres Breguet S.A., L'Abbaye (CH)

(72) Inventor: Marc Stranczl, Nyon (CH)

(73) Assignee: Montres Breguet SA, L'Abbaye (CH)

( * ) Notice: Subject to any disclaimer, the term of this patent is extended or adjusted under 35 U.S.C. 154(b) by 503 days.

(21) Appl. No.: 16/664,019

(22) Filed: Oct. 25, 2019

(65) Prior Publication Data

US 2020/0183330 A1 Jun. 11, 2020

(30) Foreign Application Priority Data

Dec. 7, 2018 (EP) ..... 18210925

(51) Int. Cl.
*G04B 17/28* (2006.01)

(52) U.S. Cl.
CPC ..... *G04B 17/285* (2013.01)

(58) Field of Classification Search
CPC ..... G04B 17/285
USPC ..... 368/202
See application file for complete search history.

(56) References Cited

U.S. PATENT DOCUMENTS

2015/0362892 A1* 12/2015 Zaugg ..... G04C 5/005 368/168
2016/0357155 A1* 12/2016 Di Domenico ..... G04B 17/04
2017/0038730 A1* 2/2017 Winkler ..... G04B 17/06
2017/0038737 A1* 2/2017 Di Domenico ..... G04B 11/026
2019/0377302 A1 12/2019 Karapatis et al.

FOREIGN PATENT DOCUMENTS

CH 707990 B1 10/2014
CH 715 049 A2 12/2019
CN 103620510 A 3/2014
CN 105652630 A 6/2016
CN 106062644 A 10/2016
CN 106990700 A * 7/2017 ..... G04B 17/28
CN 106990700 A 7/2017
CN 107908090 A 4/2018
(Continued)

OTHER PUBLICATIONS

Communication dated May 2, 2019, from the European Patent Office in counterpart European Application No. 18210925.
(Continued)

*Primary Examiner* — Edwin A. Leon
*Assistant Examiner* — Kevin Andrew Johnston
(74) *Attorney, Agent, or Firm* — Sughrue Mion, PLLC

(57) ABSTRACT

A Watch (500) including a movement (200) with a tourbillon (100) including a carriage (1) pivotally mounted about a tourbillon axis (DT) with respect to a structure (300) and carrying a balance (2) pivoting about a balance axis (DB) and arranged to cooperate in a reciprocating motion with a stop device (3) pivotally mounted on this carriage (1), and wherein this tourbillon (100) includes a fixed magnet wheel (50) fixed to this structure (300) and comprising at least one continuous magnetic track and/or comprising a series of magnets, this magnetic track being arranged to cooperate by magnetic repulsion and/or attraction with at least one magnet (33) comprised in this stop device (3) in a reciprocating motion of this stop device (3) with respect to this fixed magnetic wheel (50).

20 Claims, 7 Drawing Sheets

(56) References Cited

FOREIGN PATENT DOCUMENTS

| | | |
|---|---|---|
| EP | 2887157 A1 | 6/2015 |
| EP | 3217227 A1 | 9/2017 |

OTHER PUBLICATIONS

Communication dated Jan. 7, 2021, from The China National Intellectual Property Administration in Application No. 201911224996.3.

* cited by examiner

TIMEPIECE MOVEMENT COMPRISING A TOURBILLON WITH A FIXED MAGNETIC WHEEL

CROSS-REFERENCE TO RELATED APPLICATION

This application claims the benefit of priority from European Patent Application No. 18210925.6, filed Dec. 7, 2018, the contents of which is incorporated herein by reference in its entirety.

FIELD OF THE INVENTION

The invention concerns a timepiece tourbillon comprising a carriage pivotally mounted about a tourbillon axis with respect to a structure and carrying a balance pivoting about a balance axis and arranged to cooperate in a reciprocating motion with a stop device pivotally mounted on said carriage.

The invention also concerns a timepiece movement including at least one such tourbillon, and a main plate defining a watch plane and forming a said structure or arranged to carry a said structure.

The invention also concerns a watch including at least one such tourbillon and/or at least one such movement.

The invention concerns the field of timepiece regulating members, in particular for watches. More particularly, the invention concerns the field of precision mechanical movements with very high chronometric qualities and particularly movements comprising tourbillons.

BACKGROUND OF THE INVENTION

Magnetic escapements substantially improve the efficiency of escapement mechanisms, improve isochronism and insensitivity to positions in the field of gravity, and contribute to better chronometric precision.

The insertion of a magnetic escapement in a tourbillon or a carrousel is advantageous. Indeed, the operating frequency of the tourbillon or carrousel may be higher than that of conventional tourbillons. This higher frequency provides higher chronometric precision. The escapement has a constant force in the tourbillon carriage and thus does not depend on the inertia of the carriage. The rate is therefore precise throughout the entire power reserve. All these chronometric advantages are combined with magnetic pivots which eliminate variations caused by gravity.

Swiss Patent No. CH00601/19 in the name of MONTRES BREGUET SA discloses a timepiece, which includes a tourbillon comprising a carriage which carries a balance/balance spring and a magnetic escapement device, this latter comprising an escape wheel set, formed of at least one annular magnetic structure, and also at least one magnetic element coupled to the magnetic structure and having a oscillating motion synchronous with the oscillation of the mechanical resonator. The magnetic escapement is arranged to alternately have energy accumulation phases, from the conversion of mechanical energy provided by the barrel into magnetic potential energy in the magnetic escapement, and phases of transferring energy accumulated in the magnetic escapement to the magnetic resonator. During the energy transfer phases, the magnetic element undergoes a radial magnetic force, relative to the axis of rotation of the escape wheel set, such that the magnetic escapement then converts into mechanical energy the magnetic potential energy accumulated in the preceding energy accumulation phase in order to maintain the oscillation of the mechanical resonator.

SUMMARY OF THE INVENTION

The present invention proposes to develop the architecture of this regulating member and to simplify it by reducing the number of its components.

To this end, the invention concerns a timepiece tourbillon comprising a tourbillon according to claim 1.

The invention also concerns a timepiece movement including at least one such tourbillon, and a main plate defining a watch plane and forming a said structure or arranged to carry a said structure.

The invention also concerns a watch including at least one such tourbillon and/or at least one such movement.

BRIEF DESCRIPTION OF THE DRAWINGS

Other features and advantages of the invention will appear upon reading the following detailed description with reference to the annexed drawings, in which.

DETAILED DESCRIPTION OF PREFERRED EMBODIMENTS

Figure 1:
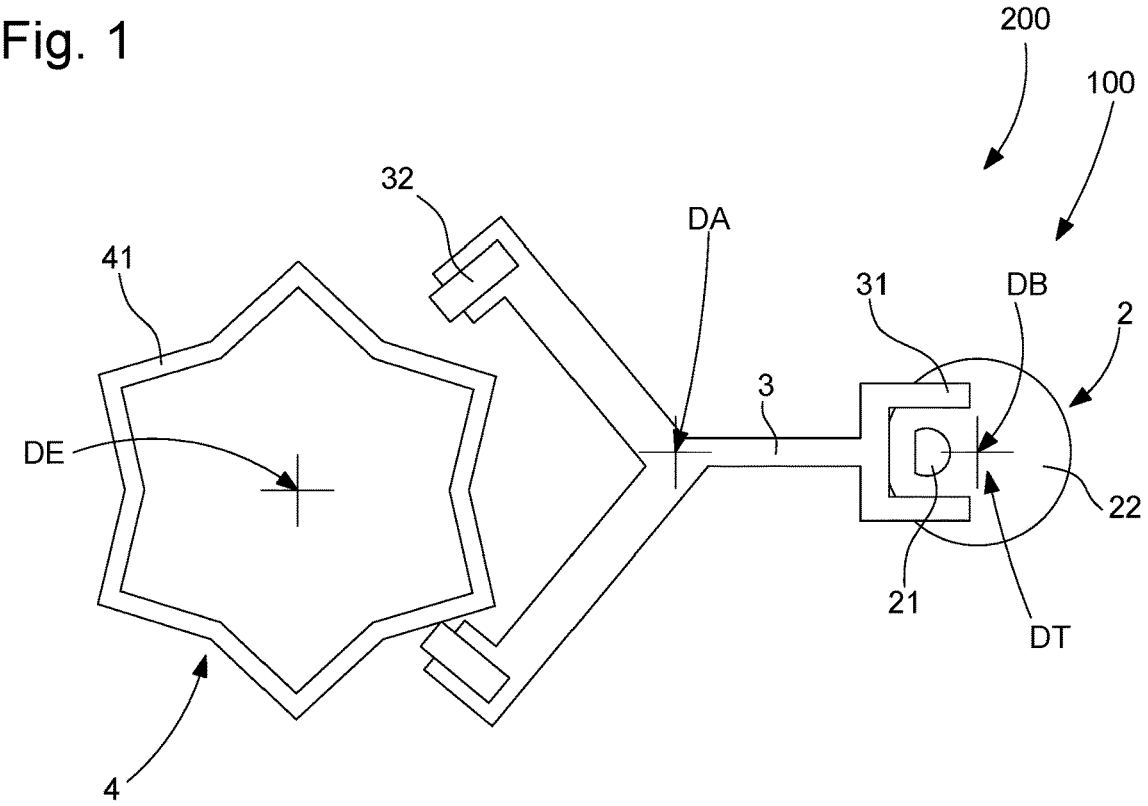
FIG. 1 represents a schematic plan view of a detail of a tourbillon mechanism with a magnetic escapement, as described in Swiss Patent No. CH00734/18 in the name of MONTRES BREGUET SA; an escape wheel set includes, on either side of a median plane, a magnetic track which in this example takes the form of a six-pointed star; magnets are mounted in place of the pallet stones of a conventional pallet lever, of the Swiss lever type; this lever cooperates in a conventional manner with an impulse pin.
Figure 2:
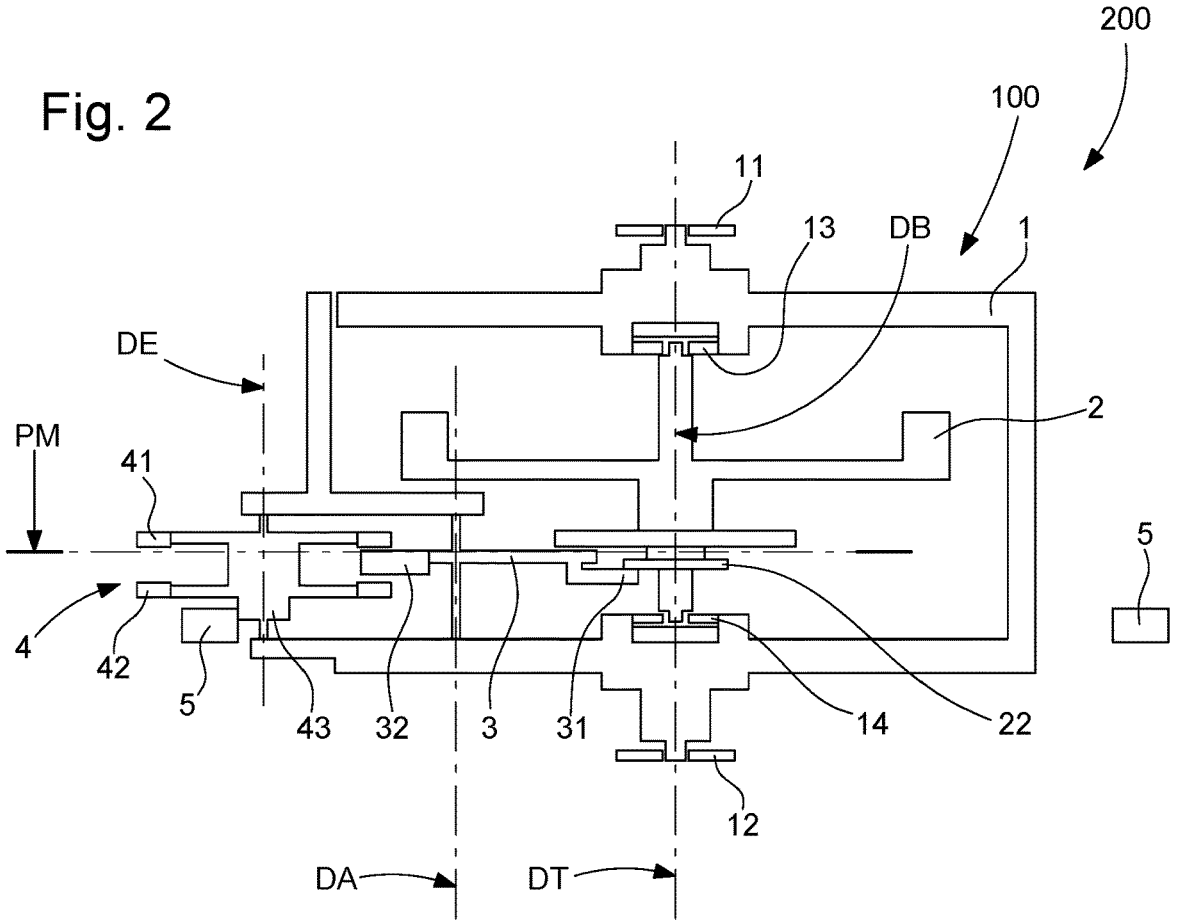
FIG. 2 represents a schematic sectional view, through the axis common to the tourbillon and the balance, of the mechanism of FIG. 1, and shows the balance coaxial to a tourbillon carriage, which carriage bears the pivots of the lever and of the escape wheel set, the escape wheel set comprises an escape pinion cooperating in a conventional manner with a large, fixed, annular, fourth wheel.

Swiss Patent No. CH00734/18 in the name of MONTRES BREGUET SA discloses a tourbillon with a magnetic escapement as shown in FIGS. 1 and 2.

An escape wheel set 4 includes, on either side of a median plane PM, a magnetic track 41, 42, which, in this example takes the form of a six-pointed star; magnets 32 are mounted in place of the pallet stones of a conventional Swiss type lever 3; this lever 3, pivoting about a lever axis DA, cooperates in a conventional manner via its fork 31, with an impulse pin 21 of a roller 22 of a balance 2 pivoting about a balance axis DB. Naturally, the presence of two magnetic tracks corresponds to a specific and advantageous variant; it is understood that a single track is sufficient to perform the function.

This balance axis DB is coincident here with the tourbillon axis DT of a carriage 1 of a tourbillon 100. Balance 2 is pivoted in bearings 13 and 14 comprised in carriage 1. Carriage 1 is carried by bearings 11 and 12 by a structure (not represented), typically comprising a main plate and a bridge or suchlike. This carriage 1 carries, in a conventional manner, the pivots of lever 3 and of escape wheel set 4. This escape wheel set 4 includes an escape pinion 43 cooperating in a conventional manner with a large, fixed, annular, fourth wheel 5.

The magnetic escapement, applied to a tourbillon, is advantageous: during operation, the stop device, generally a lever, can move under the effect of magnetic interaction, in particular magnetic repulsion, and then the escape wheel set rotates, and the carriage rotates, which, in particular, avoids having a fast escapement.

The invention intends to simplify the tourbillon architecture, by removing the escape wheel set, and by making the lever work directly with a fixed magnetic fourth wheel, as seen in FIGS. 3 to 7.

A fixed magnetic wheel 50 performs the function of the conventional fixed fourth wheel, but in direct cooperation with a stop device 3, particularly a lever 3, without an escape wheel set. This fixed magnetic wheel 50 includes at least one magnetic track, which is arranged to cooperate with at least one magnet 33 comprised in lever 3. More particularly, this magnetic track zig zags around a mean diameter, defining magnetic teeth on either side of the mean position of the lever. In the non-limiting variant illustrated by FIGS. 3 and 4, fixed magnetic wheel 50 has two, superposed, magnetic levels 51 and 52, which work in repulsion with a magnetic level 33 on at least one part of lever 3, which is thus a magnetic lever. More particularly, when carriage 1 of tourbillon 100 is required to always makes one revolution in one minute, fixed magnetic wheel 50 must comprise the right number of teeth according to the frequency of the balance, in the same way that, in a conventional mechanical tourbillon, the fixed fourth wheel has a suitable number of teeth, according to the balance frequency, to obtain a given period of rotation of the carriage.

In short, the conventional escape wheel set disappears, and fixed magnetic wheel 50 performs both the usual function of the escape wheel set and of the fixed fourth wheel of a tourbillon.

Naturally, other equivalent technological combinations can be used, for example using a fixed magnetic wheel 50 with a single magnetic level, and a magnetic lever with two magnetic levels. It is also possible to multiply the number of levels, but this runs slightly counter to the object of the invention, which is to simplify the tourbillon mechanism, and inevitably results in increasing the thickness of the mechanism. Such a multi-level variant would, however, be necessary in the case where electrostatic repulsion/attraction is substituted for the preferred magnetic repulsion/attraction illustrated here, specifically intended to obtain smaller thickness and fewer components.

Figure 3:
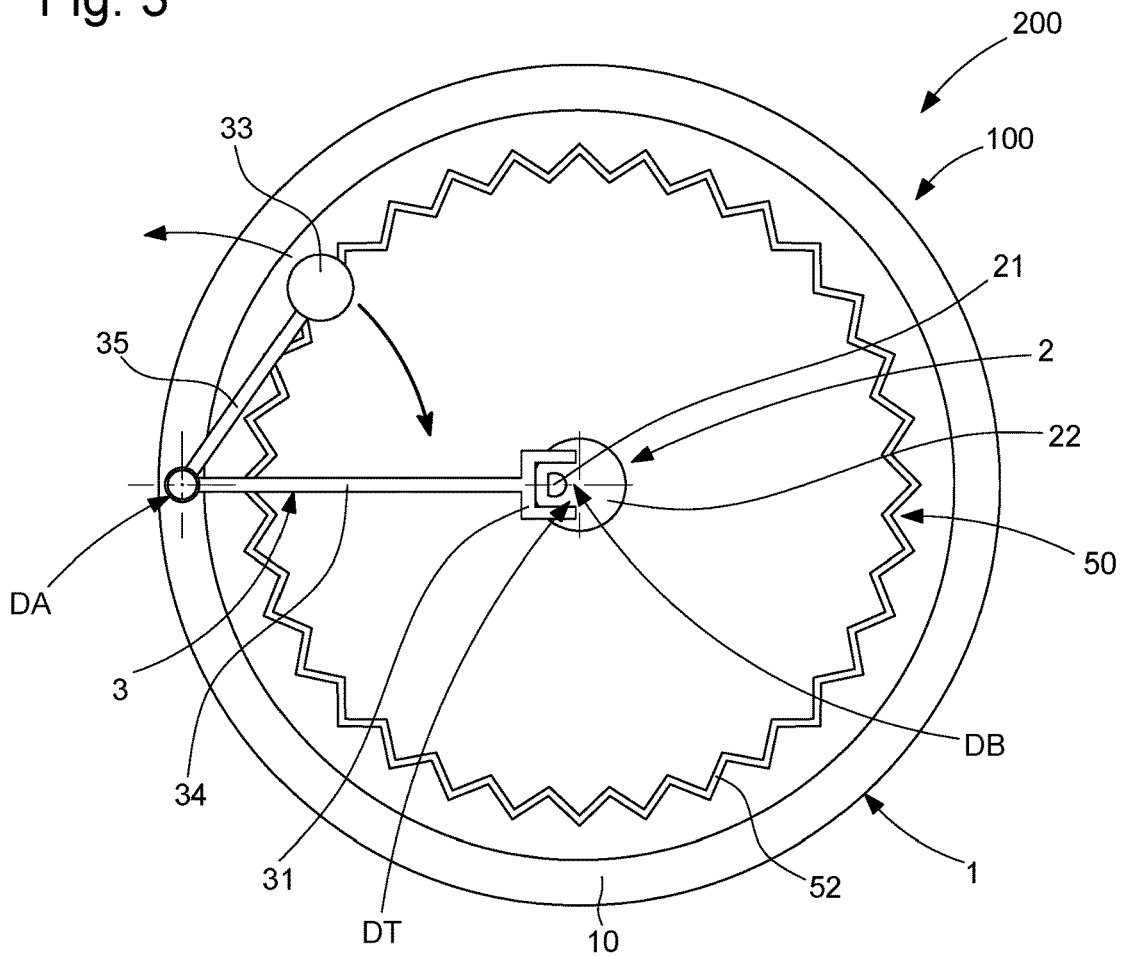
FIG. 3 represents, in a similar manner to FIG. 1, a detail of a tourbillon mechanism with a fixed magnetic wheel according to the first variant of the invention.
Figure 4:
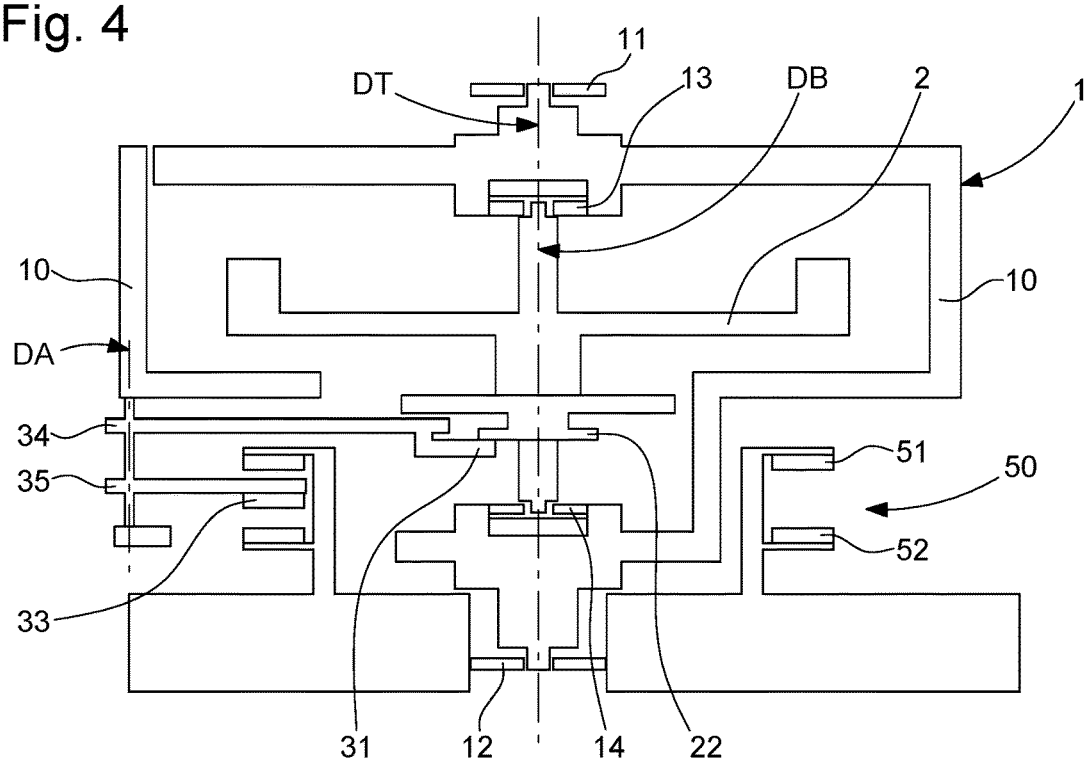
FIG. 4 represents, in a similar manner to FIG. 2, the tourbillon mechanism of FIG. 3.

The variant of FIGS. 3 and 4 comprises a balance 2 whose balance axis DB is coaxial with tourbillon axis DT. Lever 3 is bent here and articulated, substantially at the point where it bends, directly on carriage 1.

Figure 5:
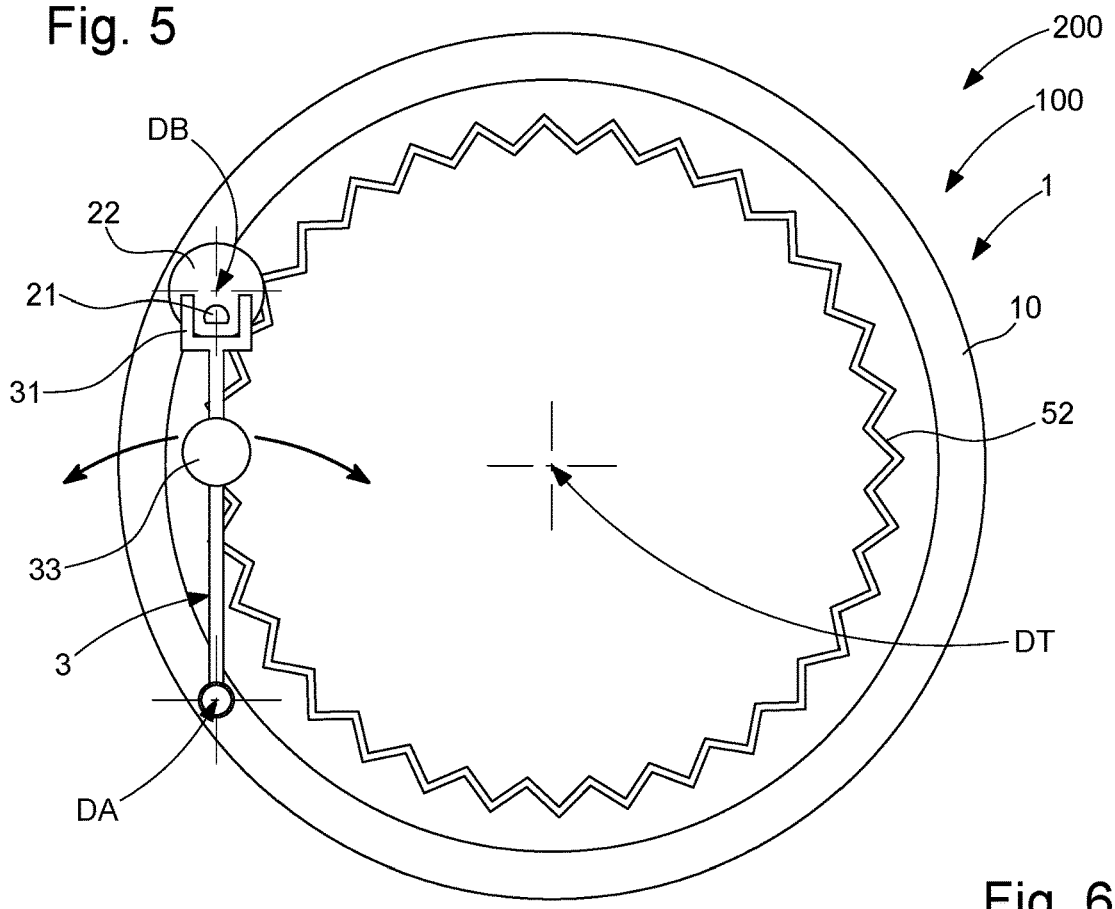
FIG. 5 represents, in a similar manner to FIG. 3, a detail of a tourbillon mechanism with a fixed magnetic wheel according to a second variant of the invention.

FIG. 5 illustrates another variant, wherein balance axis DB of balance 2 is no longer coaxial with axis of rotation DT of carriage 1 of tourbillon 100. The design of lever 3 is thereby greatly simplified, since a straight lever is sufficient to fulfil the function.

It is important to note that the invention can use either conventional balance pivots or magnetic balance pivots. The same applies to the pivots of carriage 1 of tourbillon 100.

Figure 6:
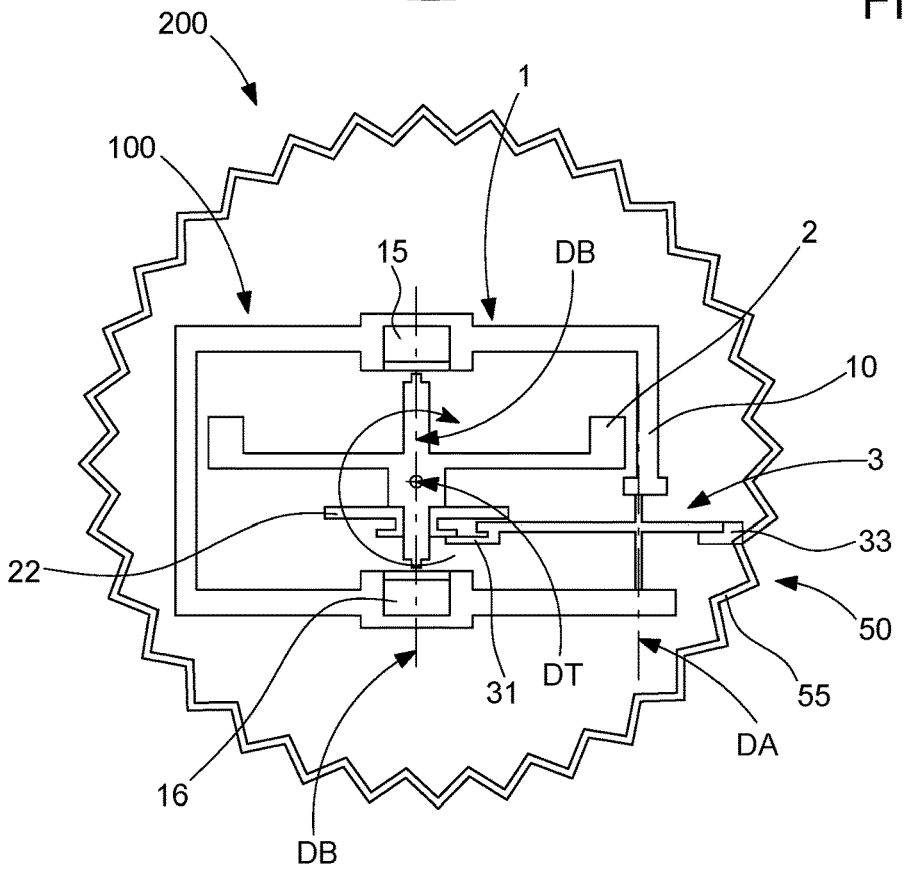
FIG. 6 represents, in a similar manner to FIG. 5, a detail of a tourbillon mechanism with a fixed magnetic wheel according to a third variant of the invention, in a first embodiment.
Figure 7:
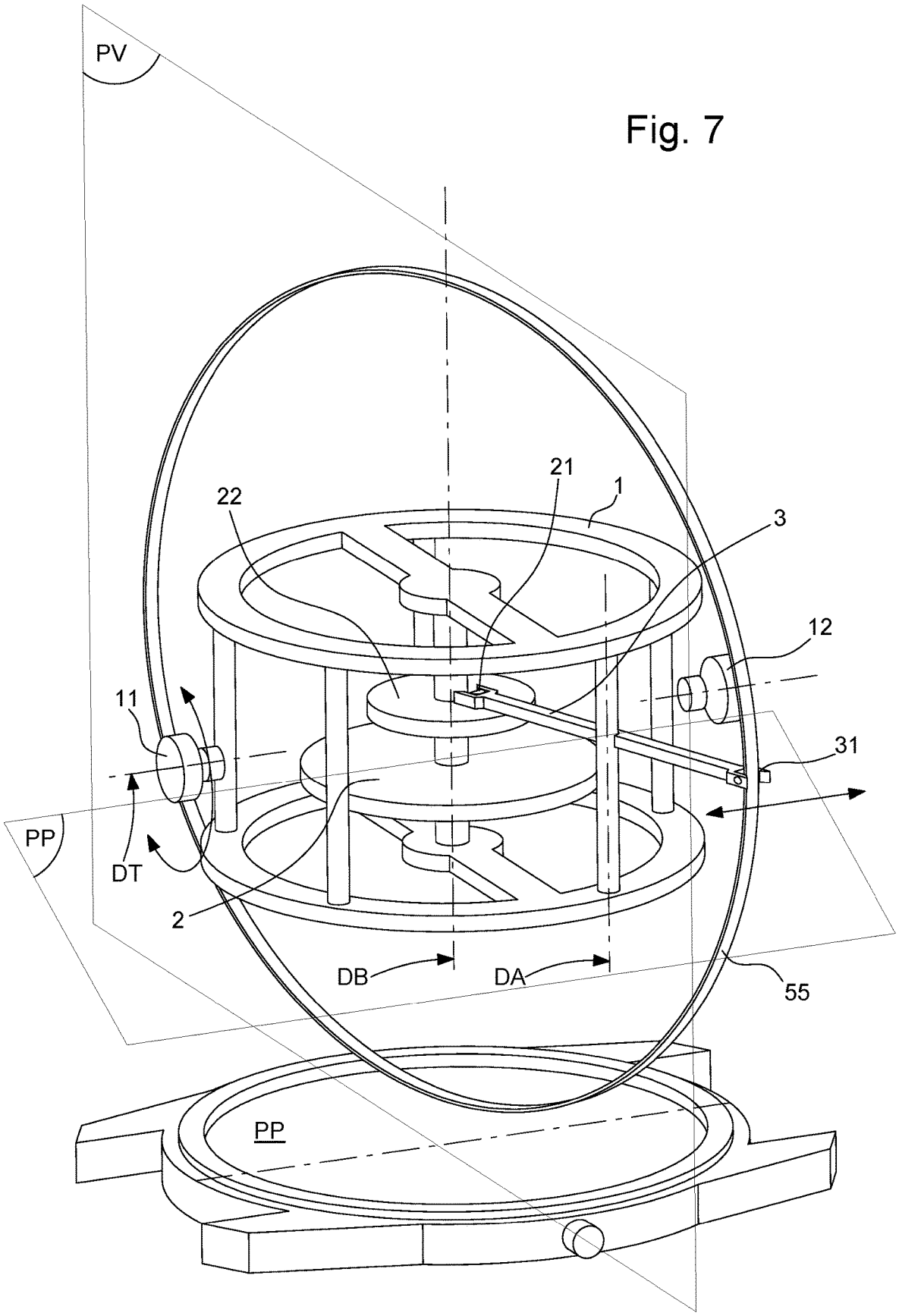
FIG. 7 represents a schematic perspective view of a detail of a tourbillon mechanism with a fixed magnetic wheel according to a third variant of the invention, in a second embodiment.
Figure 8:
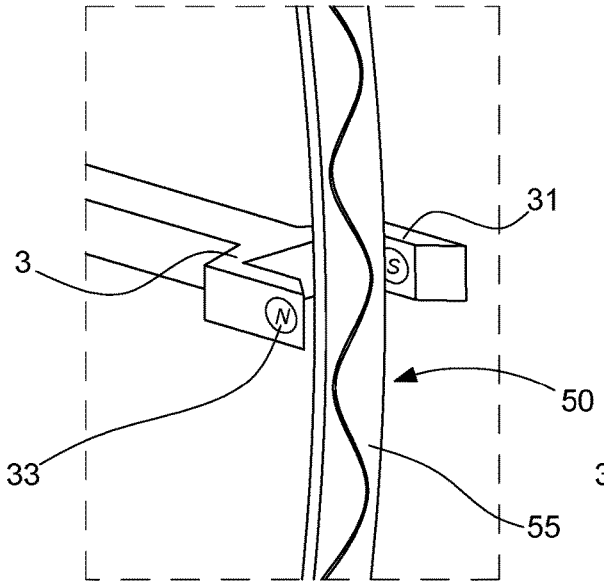
FIGS. 8 to 12 represent schematic perspective view of details of different arrangements of a fixed magnetic wheel, of the strip ring type, comprised in the invention, applied to the variant of FIG. 7.
Figure 9:
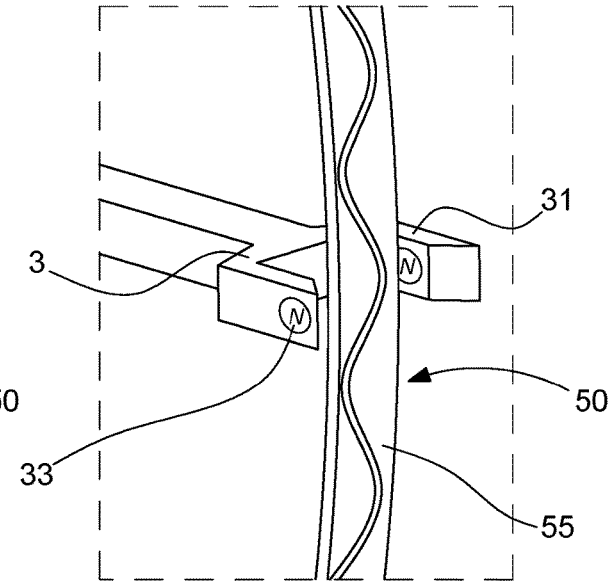
Figure 10:
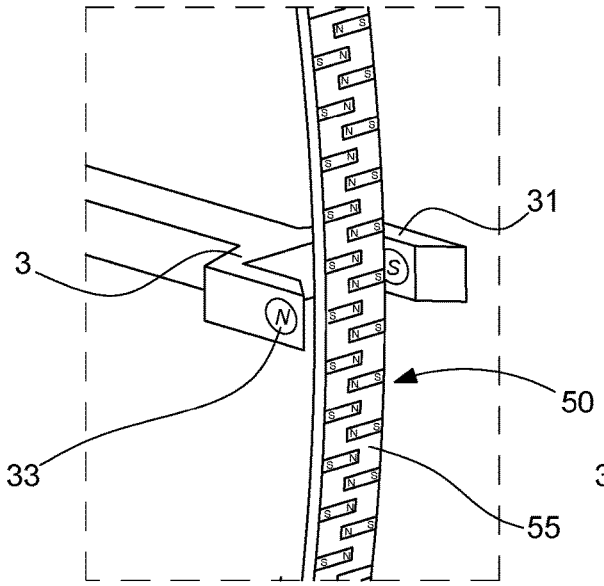
Figure 11:
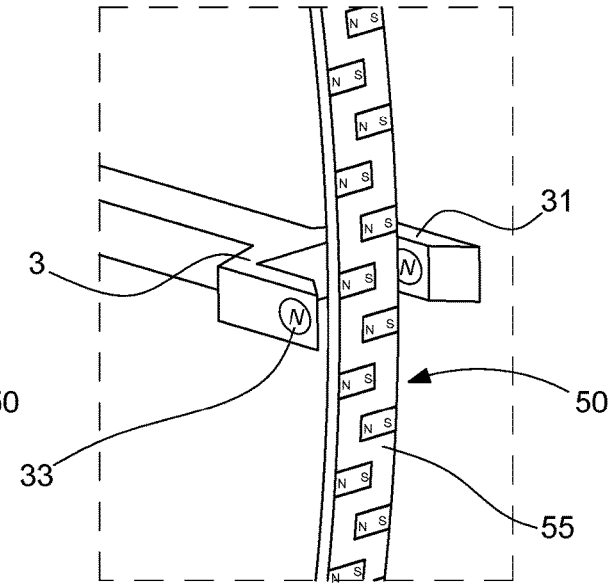
Figure 12:
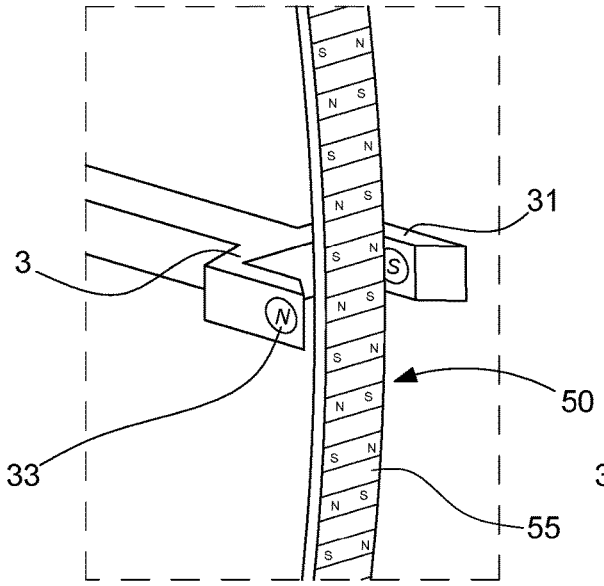
Figure 13:
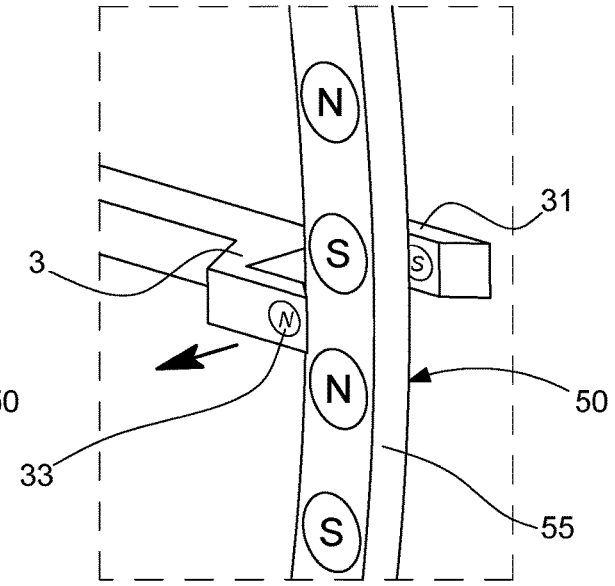
FIGS. 13 and 14 represent schematic and perspective views of details of different arrangements of a fixed magnetic wheel, of the flat ring type, comprised in the invention, applied to the variant of FIG. 6.
Figure 14:
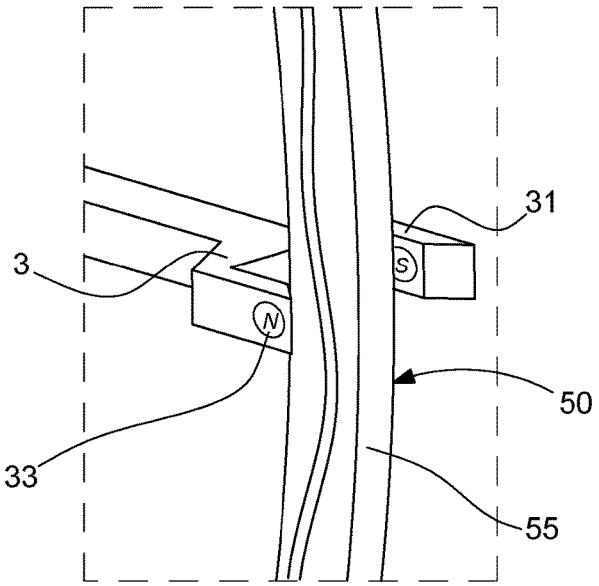
Figure 15:
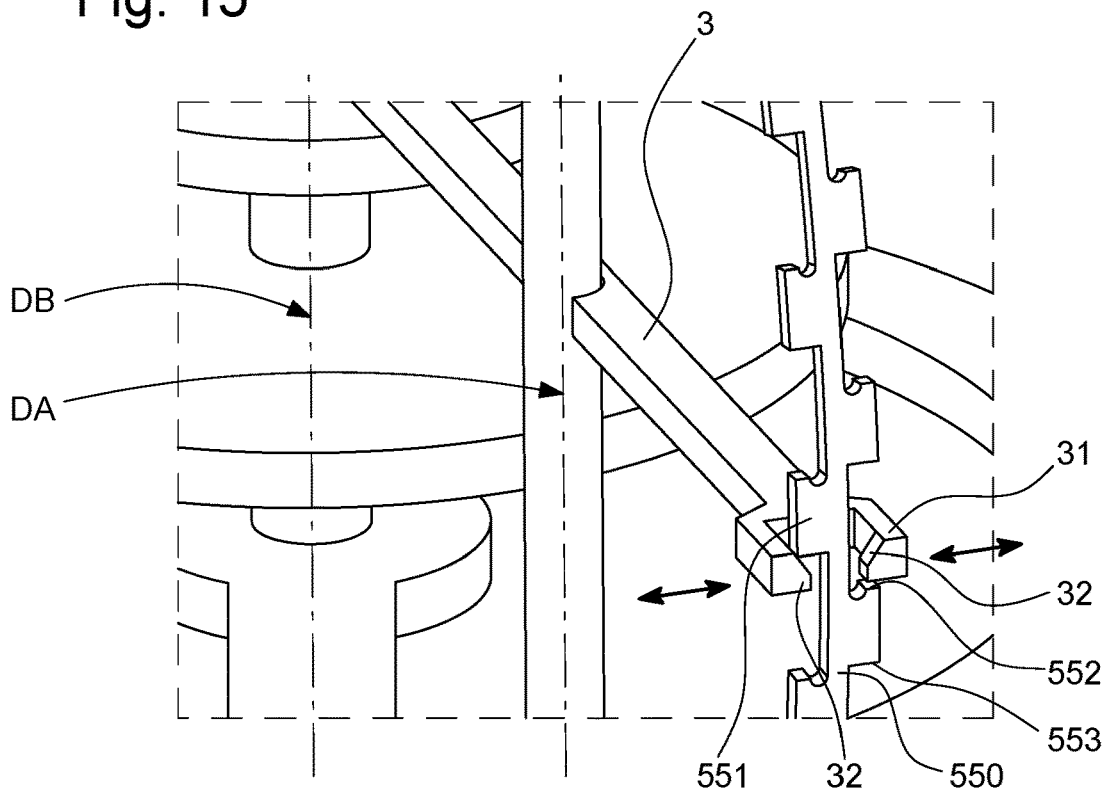
FIG. 15 represents a schematic perspective view of an extrapolation of the mechanism of FIG. 7 to a purely mechanical mechanism.

FIGS. 6 and 7 illustrate other variants, which are preferably but not exclusively implemented with magnetic pivots. Axis of rotation DT of tourbillon carriage 1 can therefore be in the plane of the watch, or in an oblique direction with respect to the plane of the watch.

The variants of FIGS. 6 and 7 thus comprise a tourbillon 100 with an axis of rotation DT of carriage 1 in plane PP of the watch, and a lever 3 which interacts directly with a fixed magnetic fourth wheel 50. This design is more voluminous than that of FIGS. 3 to 5 as regards the thickness of the watch, it is however possible to make it in a more compact form than that suggested in the Figures. The main constraint lies in the design of fixed magnetic wheel 50, which must allow passage of carriage 1 in all positions. It is to be noted that the design of the magnetic tracks is more complex and is probably restricted to operation that excludes the principle of constant force. FIG. 6 shows a fixed magnetic fourth wheel 50 with a magnetic track 55 which extends in a plane, with radial variations in magnetization: magnet 33 of the lever thus lies either opposite a tip of a tooth, with interaction, or opposite an empty space, without interaction. FIG. 7 shows a fixed magnetic fourth wheel 50 with a magnetic track 55 which extends over a surface in the form of an annular strip with a tangential variation in magnetization around this strip.

Figure 16:
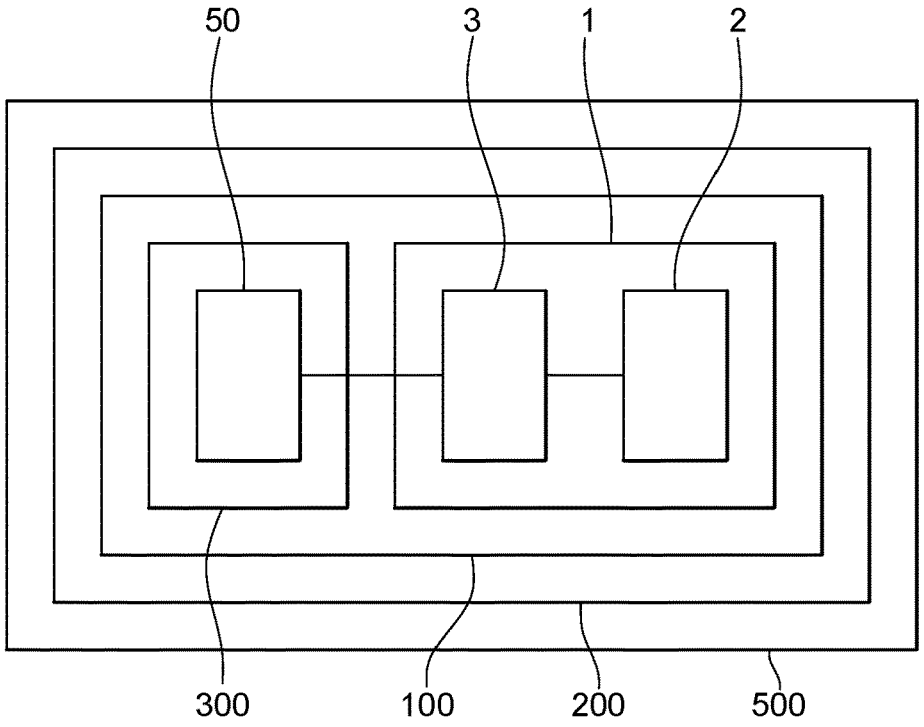
FIG. 16 is a block diagram representing a watch with a movement incorporating a tourbillon according to the invention.

This architecture is particularly advantageous and provides the possibility of better isochronism in all positions, even without enjoying the advantages of the magnetic escapement. FIG. 16 thus represents an extrapolation of the mechanism of FIG. 7 to a purely mechanical mechanism, where lever 3 pivots in the same manner on a tourbillon 100 which is in the same arrangement, with an axis of rotation DT of carriage 1 in plane PP of the watch. Pallet stones 32 of pallet fork 31 alternately cooperate with teeth 551, comprising upper 552 and lower 553 supports, comprised in a transverse fourth wheel 550 centred on said tourbillon axis DT, and which fulfils the same function as track 55 in the magnetic variant.

Thus, more particularly, the invention concerns a timepiece tourbillon 100 comprising a carriage 1 pivotally mounted about a tourbillon axis DT with respect to a structure 300. This carriage 1 carries a balance 2, or a similar inertia mass, pivoting about a balance axis DB, and arranged to cooperate in a reciprocating motion with a stop device 3, particularly a lever, pivotally mounted on carriage 1.

According to the invention, tourbillon 100 includes a fixed magnetic wheel 50, which is fixed to structure 300, and which includes at least one continuous magnetic track and/or comprising a series of magnets. This magnetic track is arranged to cooperate by magnetic repulsion and/or attraction with at least one magnet 33 comprised in stop device 3 in a reciprocating motion of stop device 3 with respect to fixed magnetic wheel 50.

More particularly, balance axis DB is distinct from tourbillon axis DT.

In a variant, particularly as seen in FIGS. 6 and 7, balance axis DB is perpendicular to tourbillon axis DT.

In a variant, particularly as seen in FIGS. 6 and 7 tourbillon axis DT is parallel to a main plate comprised in structure 300.

More particularly, balance 2 is pivotally mounted with respect to carriage 1 with magnetic bearings.

More particularly carriage 1 is pivotally mounted with respect to structure 300 with magnetic bearings.

In a particular embodiment, fixed magnetic wheel 50 includes a plurality of superposed magnetic levels 51, 52.

Advantageously, stop device 3 is pivotally mounted about a stop device axis DA which is carried by at least one peripheral area of carriage 1 farthest from tourbillon axis DT.

More particularly, balance axis DB is carried by at least one peripheral area of carriage 1 farthest from tourbillon axis DT.

As seen in the variant of FIG. 4, stop device 3 is bent at a stop device axis DA, about which this stop device 3 is arranged to pivot, and which is carried by carriage 1, on either side of which lie at least one magnet 33 and a fork 31 arranged to cooperate with an impulse pin 21 comprised in balance 2.

As seen in the variant of FIG. 4, at least one magnet 33 lies on stop device 3 between a stop device axis DA which is carried by carriage 1 and about which stop device 3 is arranged to pivot, and a fork 31 arranged to cooperate with a pin 21 comprised in balance 2.

In a variant, at least one magnetic track is planar.

In another variant, at least one magnetic track is cylindrical.

The invention also concerns a timepiece movement 200 comprising at least one such tourbillon 100, and a main plate defining a watch plane PP and forming a structure 300 or arranged to carry such a structure 300.

In a particular variant, movement 200 includes at least two tourbillons 100, whose tourbillon axes DT are neither parallel nor coincident.

In a particular embodiment, the tourbillon axis TT of at least one tourbillon 100 is parallel to watch plane PP.

In a particular embodiment, the tourbillon axis TT of at least one tourbillon 100 is oblique with respect to watch plane PP.

In a particular embodiment, the fixed magnetic wheel 50 of at least one tourbillon 100 extends substantially in a vertical plane PV perpendicular to watch plane PP.

The invention also concerns a watch 500 comprising at least one such tourbillon 100 and/or at least one such movement 200.

The invention makes it possible to simplify the design of the tourbillon, and to maintain all the advantages of a tourbillon with a magnetic escapement.

The invention claimed is:

1. A timepiece tourbillon comprising a carriage pivotally mounted about a tourbillon axis with respect to a structure and carrying a balance pivoting about a balance axis and arranged to cooperate in a reciprocating motion with a stop device pivotally mounted on said carriage, characterized in that said tourbillon includes a fixed magnetic ring, fixed to said structure and comprising at least one continuous magnetic track that is a continuous magnetic track and/or comprises a series of magnets, said magnetic track being arranged to cooperate by magnetic repulsion and/or attraction with at least one magnet comprised in said stop device in a reciprocating motion of said stop device with respect to said fixed magnetic ring.

2. The timepiece tourbillon according to claim 1, characterized in that said balance axis is distinct from said tourbillon axis.

3. The timepiece tourbillon according to claim 1, characterized in that said balance axis is perpendicular to said tourbillon axis.

4. The timepiece tourbillon according to claim 1, characterized in that said tourbillon axis is parallel to a main plate comprised in said structure.

5. A timepiece tourbillon according to claim 1, characterized in that said balance is pivotally mounted with respect to said carriage with magnetic bearings.

6. The timepiece tourbillon according to claim 1, characterized in that said carriage is pivotally mounted with respect to said structure with magnetic bearings.

7. The timepiece tourbillon according to claim 1, characterized in that said fixed magnetic ring includes a plurality of superposed magnetic levels.

8. The timepiece tourbillon according to claim 1, characterized in that said stop device is pivotally mounted about a stop device axis which is carried by at least one peripheral area of said carriage farthest from said tourbillon axis.

9. The timepiece tourbillon according to claim 1, characterized in that said balance axis is carried by at least one peripheral area of said carriage farthest from said tourbillon axis.

10. The timepiece tourbillon according to claim 1, characterized in that said stop device is bent at a stop device axis, about which said stop device is arranged to pivot, and which is carried by said carriage, on either side of which are situated said at least one magnet comprised in said stop device and a fork arranged to cooperate with an impulse pin carried by said balance.

11. The timepiece tourbillon according to claim 1, characterized in that said at least one magnet comprised in said stop device lies on said stop device between a stop device axis which is carried by said carriage and about which said stop device is arranged to pivot, and a fork arranged to cooperate with an impulse pin comprised in said balance.

12. The timepiece tourbillon according to claim 1, characterized in that at least one of said at least one magnetic track is planar.

13. The timepiece tourbillon according to claim 1, characterized in that at least one of said at least one magnetic track is cylindrical.

14. A timepiece movement comprising at least one tourbillon according to claim 1, and a main plate defining a watch plane and forming a said structure or arranged to carry a said structure.

15. The timepiece movement according to claim 14, characterized in that said movement includes at least two said tourbillons whose tourbillon axes are neither parallel nor coincident.

16. The timepiece movement according to claim 14, characterized in that the tourbillon axis of at least one said tourbillon is parallel to said watch plane.

17. The timepiece movement according to claim 14, characterized in that the tourbillon axis of at least one said tourbillon is oblique with respect to said watch plane.

18. The timepiece movement according to claim 14, characterized in that said fixed magnetic ring of at least one said tourbillon extends substantially in a vertical plane perpendicular to said watch plane.

19. A watch including at least one tourbillon according to claim 1.

20. A watch including at least one movement according to claim 14.

* * * * *